US008027494B2

(12) United States Patent
Kimura et al.

(10) Patent No.: US 8,027,494 B2
(45) Date of Patent: Sep. 27, 2011

(54) ACOUSTIC IMAGE CREATION SYSTEM AND PROGRAM THEREFOR

(75) Inventors: Masaru Kimura, Tokyo (JP); Tomoko Ishii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1167 days.

(21) Appl. No.: 11/667,937

(22) PCT Filed: Nov. 22, 2004

(86) PCT No.: PCT/JP2004/017342

§ 371 (c)(1),
(2), (4) Date: May 17, 2007

(87) PCT Pub. No.: WO2006/054360

PCT Pub. Date: May 26, 2006

(65) Prior Publication Data

US 2007/0291950 A1 Dec. 20, 2007

(51) Int. Cl.
*H04R 5/02* (2006.01)
*H04R 5/00* (2006.01)

(52) U.S. Cl. ..... 381/307; 381/1

(58) Field of Classification Search ..... 381/307, 381/17–21, 1

See application file for complete search history.

(56) References Cited

U.S. PATENT DOCUMENTS

| | | | | |
|---|---|---|---|---|
| 5,579,396 | A * | 11/1996 | Iida et al. | 381/18 |
| 7,095,865 | B2 * | 8/2006 | Katayama et al. | 381/309 |
| 2004/0062402 | A1 | 4/2004 | Fujita et al. | |

FOREIGN PATENT DOCUMENTS

| | | | |
|---|---|---|---|
| JP | 8-265899 | A | 10/1996 |
| JP | 9-200897 | A | 7/1997 |
| JP | 9-233600 | A | 9/1997 |
| JP | 2000-324600 | A | 11/2000 |
| JP | 2001-25098 | A | 1/2001 |
| JP | 2004-56418 | A | 2/2004 |

OTHER PUBLICATIONS

ISO/IEC 13818-7 3.3.8.3, p. 39, Matrix-Mixdown Process, 1997.

* cited by examiner

*Primary Examiner* — Xu Mei

(74) *Attorney, Agent, or Firm* — Birch, Stewart, Kolasch & Birch, LLP

(57) ABSTRACT

With stereophonic sound images of multi-channel audio signals well maintained, 2-channel system audio signals are created. An acoustic image creation system includes: a left-rear localization processing means 2 for outputting a left-rear localization signal by summing together a left signal 101 and a left-rear signal 103, among audio input signals including the left signal 101, a right signal 102, the left-rear signal 103, and a right-rear signal 104, and processing the summation result with a rear localization processing filter; a right-rear localization processing means 3 for outputting a right-rear localization signal by summing together the right signal 102 and the right-rear signal 104, and processing the summation result with a rear localization processing filter; and an acoustic image creation means 4 for creating the surround sound image signals from the left signal 101, the right signal 102, the left-rear localization signal 103, and the right-rear localization signal 104.

14 Claims, 4 Drawing Sheets

| | |
|---|---|
| Gl1, Gr1 | 0–1/4 |
| Gl2, Gr2 | 1/4–1/2 OR 1/2--1/4 |
| Gl3, Gr3 | 1/4–1/2 |
| Gl4, Gr4 | -1/4–+1/4 |
| Gl5, Gr5 | -1/4–0 |

| | |
|---|---|
| Gc | $1/2-1/\sqrt{2}$ |
| Glfe | 0–1/2 |
| Gls, Grs | $1/(2\sqrt{2})-1/\sqrt{2}$ |

| | |
|---|---|
| Gc | $1/2-1/\sqrt{2}$ |
| Glfe | 0–1/2 |
| Gls, Grs | $1/(2\sqrt{2})-1/\sqrt{2}$ |
| Gl1, Gr1 | $1/4-1/\sqrt{2}$ |
| Gl2, Gr2 | -1/8–+1/8 |
| Gl3, Gr3 | 1/8–1/2 |
| Gl4, Gr4 | -1/8–+1/8 |
| Gl5, Gr5 | -1/8–0 |

ACOUSTIC IMAGE CREATION SYSTEM AND PROGRAM THEREFOR

TECHNICAL FIELD

This invention relates to technologies in which pseudo-surround sound images are reproduced by using a left-right pair of loudspeakers, based on multi-channel audio input signals.

BACKGROUND ART

The public's attention is currently focused on DVDs as digital contents storage media that are to replace CDs. Since the DVD media have a storage capacity larger than that of conventional CD media, not only motion-picture data can be stored, but also multi-channel audio signal data, e.g., 5.1-channel audio signals, can be recorded. Reproducing such multi-channel audio signals allows the sense of being present to be created even at home, as in a movie theater.

In order for the sense of being present to be created, by reproducing such multi-channel audio signals, however, a multi-channel audio signal reproduction system such as an amplifier to drive each of loudspeakers is required along with multiple loudspeakers whose quantity exceeds two. A 5.1-channel system, for instance, would require five loudspeakers or more. Such a large quantity of the loudspeakers need to secure some extra space for their arrangement. Additionally, wiring-interconnections between the signal reproduction system and the loudspeakers become complex. Given the present circumstances, even though low-cost reproduction systems and loudspeakers become available in the market, promotion of their widespread use is unlikely to be anticipated.

This background demands, with the already-widespread two-speaker system configuration remaining unchanged, a technology to create surround sound images by reproducing the multi-channel audio signals. As an example of such technology, the methods referred as to SET1 and SET2 have been disclosed in non-Patent Document 1.

In addition, a method is proposed—by e.g., Patent Document 1—as well in which, using a pair of loudspeakers, stereophonic surround sounds are reproduced by front-side stereophonic signals, and rear-localized stereophonic rear signals—rear sounds.

Patent Document 1

Japan Patent Publication H08-265899 "SURROUND-SOUND SIGNAL PROCESSING SYSTEM AND VIDEO SOUND REPRODUCTION SYSTEM"

Non-Patent Document 1

ISO/IEC 13818-7 Section 3.3.8.3

DISCLOSURE OF INVENTION

Problem that the Invention is to Solve

An SET1 configuration as in non-Patent Document 1 can create no surround sound sensation and rear-localization; an SET2 configuration, while creating the surround sound sensation to a certain extent, causes localization information to disappear due to reproducing by a left-right pair of loudspeakers in the opposite phase to each other, a combined signal of right-rear and left-rear signals; thus, there has been a problem in that a reproduction sound field with the sense of being present as in a movie theater is incapable of being created.

Additionally, in the art disclosed in Patent Document 1 as well, a rear left signal and a rear right signal are summed together, via each of left and right acoustic image localization filters, with a left signal and a right signal, respectively, there has been a problem in that crosstalk is generated, thereby causing the localization sensation to disappear even though a sense of spaciousness is created.

Means for Solving the Problem

An acoustic image creation system according to the present invention, for reproducing a pair of surround sound image signals from audio input signals including a left signal, a right signal, a left-rear signal, and a right-rear signal, in order to solve such problems, the acoustic image creation system comprises: a left-rear localization processing means for outputting a left-rear localization signal by summing together the left signal and the left-rear signal and for performing a rear-localization-filtering-process on the summation result; a right-rear localization processing means for outputting a right-rear localization signal by summing together the right signal and the right-rear signal and for performing a rear-localization-filtering-process on the summation result; and an acoustic image creation means for creating the surround sound image signals, from the left signal, the right signal, the left-rear localization signal, and the right-rear localization signal.

Effects of the Invention

In this way, when the left-rear signal and the right-rear signal are processed by the rear localization filters, the acoustic image creation system according to the present invention sums together the left signal—the left-front signal—and the left-rear signal—and sums together the right signal—the right-front signal—and the right-rear signal; then, the summation result signals are each processed by the rear localization filters. This arrangement processes with the rear localization filters, part of the left signals along with the left-rear signal, and similarly, processes with the rear localization filters, part of the right signals along with the right-rear signal; therefore, more stereoscopic sound images can be created, in comparison with a case in which only the left- and right-rear signals are processed by rear localization filters.

REFERENCES OF NUMERALS AND SYMBOLS

"1" is an acoustic image creation system; "2," left-rear localization processing means; "3," right-rear localization processing means; "4," acoustic image creation means; "101," left signal; "102," right signal; "103," left-rear signal; "104," right-rear signal; "108*a*," "108*b*," "109*a*" and "109*b*," multiplier; "114" and "115," adder; "117*a*," "117*b*," "118*a*" and "118*b*," multiplier; "123" and "124," adder; "125" and "127," multiplier; "130," "131," "135" and "136," rear localization filter; and "140," wide stereo circuit.

BEST MODE FOR CARRYING OUT THE INVENTION

Embodiment 1

Figure 1:
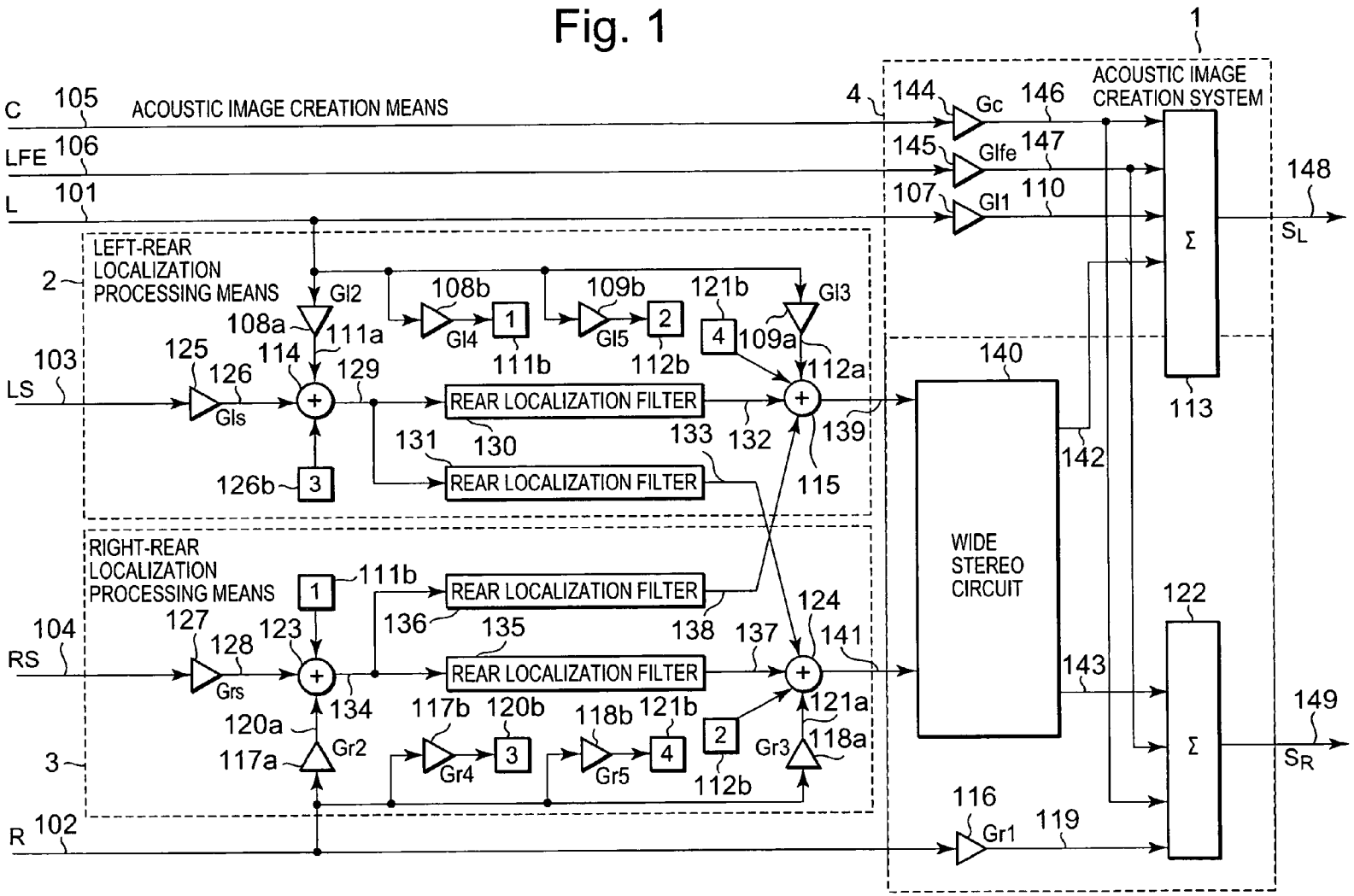
FIG. 1 is a block diagram illustrating a configuration of an acoustic image creation system according to Embodiment 1 of the present invention.

FIG. 1 is a block diagram showing a configuration of an acoustic image creation system according to the present invention. Referring to FIG. 1, the acoustic image creation system is a system that uses 5.1 channel audio signals as the input signal, and includes a left localization processing means 2, a right localization processing means 3, and an acoustic image creation means 4. Outside the acoustic image creation system 1, there is a device such as a DVD player, not shown, that sends multi-channel audio signals. From the device, as input signals, a left signal 101, a right signal 102, a left-rear signal 103, a right-rear signal 104, a central signal 105, and a low sound effect signal 106 are inputted into the acoustic image creation system 1. By performing signal-processing of these signals as will be described below, the acoustic image creation system 1 outputs a left output signal 148 and a right output signal 149, thereby creating surround sound images.

It should be noted that in the description below, the left signal is represented as an L signal; the right signal, an R signal; the left-rear signal, an LS signal; the right-rear signal, an RS signal; the central signal, a C signal; the low-sound effect signal, an LFE signal.

When being inputted into the surround sound image creation system 1, the L signal is first divided into two parts: one, being inputted into the left-rear region localization processing means 2; and the other, being inputted into the acoustic image creation means 4.

The rear localization processing means 2 includes multipliers 108*a*, 108*b*, 109*a*, 109*b* and 125, adders 114 and 115, and rear localization filters 130 and 131. The L signal 101, the LS signal 103, and further a signal 138 outputted from the right-rear localization processing means 3, as will be described later, are assigned as input signals.

The left-rear localization processing means 2 distributes the inputted L signal 101 to the multipliers 108*a*, 108*b*, 109*a*, and 109*b*. The multiplier 108*a* multiplies the L signal by a gain coefficient G12, to generate a signal 111*a* that is outputted into the adder 114. Also, the multiplier 109*a* multiplies the L signal by a gain coefficient G13, to generate a signal 112*a* that is outputted into the adder 115.

Furthermore, the multiplier 108*a* multiplies the L signal 101 by a gain coefficient G14, to weight the L signal 101, so that a signal 111*b* is produced. The signal 111*b* produced by the multiplier 108*b*, aiming at summing together part of the left signal and the right-rear signal, is inputted into an adder 123 of the right-rear localization processing means 3, as will be described later.

Also, the multiplier 109*b* multiplies the L signal 101 by a gain coefficient G15 so as to weight the L signal 101, thus causing a signal 112*b* to be generated. The signal 112*b* produced by the multiplier 109*b*, aiming at summing together part of the left signal and the right-rear signal, is inputted into the adder 124 of the right-rear localization processing means 3, as will be discussed later.

Also, the left-rear localization processing means 2, by using the multiplier 125, multiplies the inputted LS signal 103 by a gain coefficient G1*s*, to weight the LS signal 103, and outputs to the adder 114 a resulting signal 126 obtained thereby. The adder 114 sums together the signal 111*a*, the signal 126, and a signal 120*b* that is to be produced in accordance with the R signal, as will be discussed later, so that a signal 129 is obtained as the summation result.

When, in general, multi-channel audio signals are reproduced by multi-channel loudspeaker system that has an intrinsically assumed speaker quantity and arrangement, the left and right signals' partially traveling into the left-rear area of a listener will help create stereoscopic acoustic images. According to conventional methods in which the multi-channel audio signals are decoded into 2-channel audio signals, however, such effects has not been achieved because the left signal and the right signal have not been processed by the left-rear localization filters. Since the acoustic image creation system 100 is provided with the adder 114 that sums together part of the left signal (the signal 111*a*) and part of the right signal (the signal 120*b*) with the left-rear signal (the signal 126), the creation system 100 can cause the left and right signals to contribute to the left-rear signal, so that a stereoscopic sound field can be reproduced that is approximate to that by a loudspeaker system defined by multi-channel audio signals.

Furthermore, by providing the creation system 100 with the multipliers 108*a* and 125, the L signal 101 and the LS signal 103 are multiplied by the gain coefficients G12 and G1*s*, respectively, and the signals 111*a* and 126, after being weighted, are summed together. This enables, in the rear localization filtering-process, the degree of the left signal's contribution to the left-rear signal to arbitrarily be controlled.

The signal 129 outputted from the adder 114 is divided into two signals: one, being inputted into a rear localization filter 130, and the other, into the rear localization filter 131. The rear localization filter 130 obtains an output signal 132 by applying a predetermined spatial transfer function to the signal 129 as the input signal. The signal 132 outputted from the rear localization filter 130 is inputted into the adder 115. The rear localization filter 131 will be discussed later.

Here, a spatial transfer function is a function for simulatively computing spatial transfer characteristics, for the left-rear signal, up until arriving at the listener's left or right ear; spatial transfer functions are well known in the art, as functions for obtaining output signals, by considering the degree, etc., of frequency modulation caused by actions of the outer ear flaps (the pinnae) and by a time lag for the left-rear signal to arrive at the left ear, in comparison with, for instance, the left signal to arrive thereat.

As a configurational example of the rear localization filters 130 and 131, a filter is desirable to be employed that is approximate to spatial transfer functions from sound sources in the direction between an azimuth angle of minus 100 degrees—the left-rear area of the listener—and that of minus 120 degrees, to the left and right ears of the listener.

Namely, given that the transfer function from the sound sources in the direction between an azimuth angle of minus 100 degrees—the left-rear area of the listener—and minus 120 degrees, to the left ear of the listener, is represented as H11(*z*); and that the transfer function from the sound source in the direction between an azimuth angle of minus 100 degrees—the rear-left area of the listener—and minus 120 degrees, to the right ear of the listener, is represented as H1*r*(*z*) then the rear localization filters 130 and 131 to which transfer functions of H11(*z*) and H1*r*(*z*), are assigned, respectively are used. Both transfer functions may be completely identical with those of H11(*z*) and H1*r*(*z*), or those that approximates the transfer functions to the extent that the accuracy of the localization is not degraded may be used.

Using a filter having such transfer functions makes signals, presented to the left and right ears of the listener, approximately equal to sounds arriving at the left and the right ears of the listener from the sound source in the direction between an azimuth angle of minus 100 degrees—the left-rear area of the listener—and that of minus 120 degrees, thereby the listener creates an illusion as if input signals would exist in the direction between an azimuth angle of minus 100 degrees—the left-rear area of the listener—and that of minus 120 degrees.

Also, given a signal S (z), at this moment, as a Z transform representation of the input signal into the rear localization filters 130 and 131, the signal 132 is represented as S(z)H11 (*z*), and a signal 133, as S(z)H1*r*(*z*).

The adder 115 sums together the signal 112*a* obtained by weighting a result acquired by multiplying the L signal 101 by the gain coefficient G13 the signal 132 outputted from the rear localization filter 130, a signal 138 outputted from the rear localization filter 136 of the right-rear localization processing means 3, and the signal 121*b* obtained by multiplying, using the multiplier 118*b*, the R signal 102 by a gain coefficient Gr5.

Although in the rear localization filter 130, the rear localization filtering process is implemented to the left-rear signal 129 to which part of the left signal 102 has been contributed, thus resulting in the surround sound sensation being achieved; on the other hand, sound quality—the sense of cleanness—in some cases, may be degraded. In such a case, by summing, using the adder 115, the rear-localization-filtering process processing result—the signal 132—together with the left signal—the signal 112*a*—again, the sound quality can be enhanced. Furthermore, the amplitude of the signal 112*a* is made to be controlled by the gain coefficient G13, so that either the sound quality or the surround-sound sensation or both can appropriately be controlled by locations of a listener/user and loudspeakers.

Furthermore, the adder 115 has summed a signal 118*b* that is generated according to the right signal 102 as well, together with the rear-localization-filtering-process processing result—the signal 132—so that the right signal 102's contribution to the left-rear signal has been enhanced, to aim at improving the sound quality. Still furthermore, since the signal 118 is multiplied by the gain coefficient Gr5, either the sound quality or the surround-sound sensation, or both can appropriately be controlled as well.

The same processing as the rear localizing filtering process to the L signals 101 and the LS signal 103, as stated above, is implemented to the R signal 101 and the LS signal 103 as well, by the right-rear localization processing means 3. In other words, when inputted into the surround sound image creation system 1, the R signal 102 first is divided into two signals; one, being inputted into the right-rear region localization processing means 3, and the other, being inputted into the acoustic image creation means 4.

The right-rear localization processing means 3 includes multipliers 117*a*, 117*b*, 118*a*, 118*b* and 127, adders 123 and 124, and the rear localization filters 135 and 136. The R signal 102, the RS signal 104, and the signal 133 outputted from the left-rear localization processing means 2, are regarded as the input signals.

The right-rear localization processing means 3 distributes the inputted R signal 102 into the multipliers 117*a*, 117*b*, 118*a*, and 118*b*. The multiplier 117*a* multiplies the R signal by a gain coefficient Gr2, to generate a signal 120*a*, and outputs it to the adder 123. Also, the multiplier 118*a* multiplies the R signal by a gain coefficient Gr3, to generate a signal 121*a*, outputting it to the adder 124.

The multiplier 117*b* multiplies the R signal 102 by a gain coefficient Gr4, to generate a signal 117*b*, and outputs it to the adder 114 of the left-rear localization processing means 2. Also, the multiplier 118*b* multiplies the R signal 102 by the gain coefficient Gr5, to generate a signal 121*b*, outputting it to the adder 115 of the left-rear localization processing means 2.

Furthermore, the right-rear localization processing means 3 multiplies, by using the multiplier 127, the inputted RS signal 104 by a gain coefficient Grs, to output into the adder 123 a signal 128 obtained thereby. The adder 123 sums the signal 120*a* and the signal 11*b* as a result outputted from the multiplier 108*b* in the left-rear localization processing means 2, together with the signal 128, and outputs the signal 134. An effect achieved by providing the right-rear localization processing means 3 with the adder 123 is the same as that obtained by providing the left-rear localization processing means 2 with the adder 114. In addition, an effect achieved by providing the right-rear localization processing means 3 with the multipliers 117*a* and 127 is same as that obtained by providing the left-rear localization processing means 2 with the multipliers 108*a* and 125.

The signal 134 is divided into two parts: one, being inputted into the rear localization filter 135; and the other, into the rear localization filter 136. The rear localization filter 135 obtains an output signal 137 by applying a spatial transfer function to the signal 134 as input signal as well as the rear localization filter 130. The signal 137 outputted from the rear localization filter 135 is inputted into the adder 124. The adder 124 sums together the signal 121 obtained by multiplying the R signal 102 by the gain coefficient Gr3, and the signal 137 outputted from the rear localization filter 135. An effect produced by providing the right-rear localization processing means 3 with the adder 124 is the same as that produced by the adder 115 in the left-rear localization processing means 2.

In the acoustic image creation system as shown in FIG. 1, additional features lie in that the left-rear localization processing means 2 and the right-rear localization processing means 3 are provided with the rear localization filter 131 and the rear localization filter 136, respectively. In the rear localization filter 131, the signal 129 to be outputted from the right-rear processing mean 3 is processed by the rear localization filter having a predetermined spatial transfer function, and the output signal 133 to be obtained as a processing result is outputted into the adder 124 of the right-rear localization means.

The signal 129 inputted into the rear localization filter 131 is a signal obtained according to the LR signal 101, and the LS signal 103. The adder 124 sums together the rear-localization-processed signal 137 obtained by processing the R signal 102 and the RS signal 104 with the rear localizing filter 135, and the signal 133 as well as the signal 112*b*.

This arrangement makes it possible for components by which the left signal and the left-rear signal contribute to the right-rear signal, to be represented. When multi-channel audio signals are reproduced by a multi-channel loudspeakers system that has an essentially assumed speaker quantity and location, while parts of the left and left-rear signals' traveling into the right-rear area of a listener help enhance the stereoscopic sense of acoustic images, the provision of the rear localization filter 131 allows such effects to be simulated in a 2-channel system as well.

The rear localization filter 136 processes the signal 134 as well, as in the case of the rear localization filter 131, by applying a predetermined spatial transfer function, and outputs to the adder 115 the output signal 138. The adder 115 sums together the rear localization processing-processed signal 132, and the signal 138 along with the signal 121*b*. This effect is the same as that obtained by the rear localization filter 131.

The signal 139 outputted from the adder 115, and the signal 141 outputted from the adder 124 are inputted into the acoustic image creation means 4. The acoustic image creation system 4 includes a wide stereo circuit 140, mixers 113 and 122, and multipliers 107, 116, 144, and 145. The acoustic image creation system 4 inputs into the wide stereo circuit 140 signals 139 and 141. The wide stereo circuit 140 is a circuit that processes the signal 139 as the input left signal, and the signal 141 as the input right signal so that the acoustic images are spread when their stereo sound reproduction is performed, and that outputs into the mixer 113 the left output signal 142 as well as outputs into the mixer 122 the right output signal 143.

Figures 2, 3, 4:
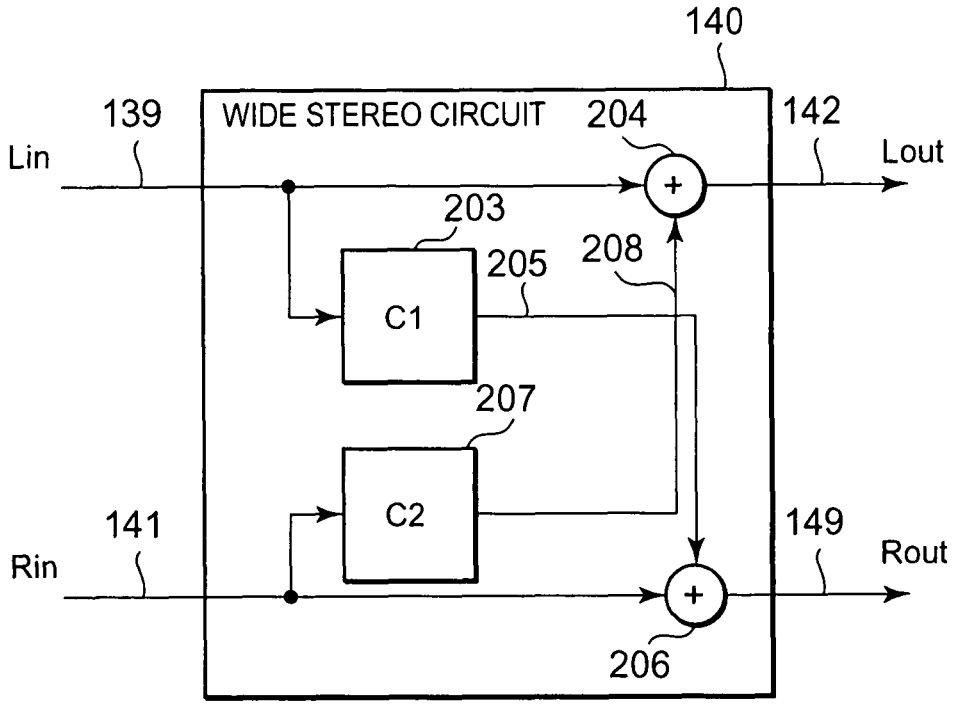
FIG. 2 is a block diagram illustrating a detailed configuration of an acoustic image creation system according to Embodiment 2 of the present invention.
FIG. 3 is an example of a gain coefficient set for use in the acoustic image creation system according to Embodiment 1 of the present invention.
FIG. 4 is an example of a gain coefficient set for use in the acoustic image creation system according to Embodiment 1 of the present invention.

FIG. 2 is a block diagram in a case in which the wide stereo circuit 140 is configured as, e.g., a crosstalk canceller. The input left signal 139 is distributed and inputted into a first filter 203 and an adder 204. The first filter 203 filters the input signal 139, to output into an adder 206 an obtained signal 205.

An input right signal 141 as well as the input left signal 139 is also distributed and inputted into a second filter 207 and the adder 206. The second filter 207 filters the signal 141 to output into the adder 204 an obtained signal 208. The adders 204 and 206 each sum together two signals inputted, to output each of the summation results, as the left output signal 142 and the right output signal 143, from the wide stereo circuit 140, respectively.

When the wide stereo circuit is configured as shown in FIG. 2, it is preferable that the filters 203 and 207 have such characteristics that their phase characteristics largely vary, and their amplitudes are attenuated with respect to their input signals.

Furthermore, the configuration of the wide stereo circuit 140 is not limited to that shown in FIG. 2 but, for instance, a simplified configuration in which reverse-phase signals are superimposed onto signals on the opposite side each other may be adopted. Utilizing a wide stereo circuit that implements an HRTF (head-related transfer function) provides a possible configuration as well.

In the acoustic image creation system 1, the left-rear signal 139 and the right-rear signal 141 are made to be processed by the wide stereo circuit 140 in this fashion, so that not only a stereo-sound image is expanded, but also only signals outputted from a filter having a low amplitude are added to signals that do not significantly distort the left and right signals; thereby effects lie in that wide stereo sound signals that are very little degraded in sound quality can be acquired.

The acoustic image creation means 4 produces a signal 110 by multiplying, using the multiplier 107, the L signal 101 by a gain coefficient G11. In addition, using the multiplier 11, the creation means 4 produces a signal 119 by multiplying the R signal 102 by a gain coefficient Gr1. Furthermore, using the multiplier 144, the creation means 4 produces a signal 146 by multiplying the C signal 105 by a gain coefficient Gc. Still furthermore, using the multiplier 145, the creation means 4 produces a signal 147 by multiplying the LFE signal 106 by a gain coefficient G1*fe*.

Finally, the acoustic image creation means 4 produces a signal 148 (an $S_L$ signal)—a final output signal from the acoustic image creation system 1—by mixing, using a mixer 113, the signal 110 produced from the L signal 101, a signal 142—the left output signal from the wide stereo circuit 140—the signal 146 produced from the C signal 105, and the signal 147 produced from the LFE signal. Likewise, the creation means 4 produces the signal 119 produced by means of the mixer 122 from the L signal 102, the signal 143—the right output signal from the wide stereo circuit 140—and a signal 149 (an $S_R$ signal)—a final right output signal produced by mixing the signal 146 and the signal 147.

In the acoustic image creation system 1 according to Embodiment 1 of the present invention, the L and R signals are processed in this way by the wide stereo processing and the rear localization filter, thereby reproduced acoustic images with a sense of being very spacious can be presented. Moreover, both the LS and RS signals are processed by the rear localization filter as well, thus allowing rear surround signals to be presented that are comparable to those reproduced by a multi-loudspeaker system.

Effects also lie in that only adjusting gain coefficients G11 through G15, and $G_R$1 through $G_R$5, with respect to the L and R signals allows the sense of spaciousness to be adjusted. Gain coefficients desirable to enhance, e.g., the sense of spaciousness includes a gain coefficient set as shown in FIG. 3. Furthermore, in combination with this coefficient set, gain coefficients G1*s*, Grs, 144 and 145 of the multipliers 125, 127, 144 and 145, respectively may be set at values as shown in FIG. 4 as well.

In other words, if the gain coefficients G12 and Gr2 are made to be comparatively large, the rear localization filter enables the sense of spaciousness in the left and right signals' acoustic images to be expanded up to the rear of the listener; if the gain coefficients G13 and Gr3 are made to be comparatively large, the wide stereo sound processing allows the sense of spaciousness in the left and right signals' acoustic images to be expanded laterally. This allows surround sound images to effectively be created even in a narrow sound reproduction environment in which an azimuth angle between the left and right loudspeakers with respect to the listener is 60 degrees or less.

Figures 5, 6:
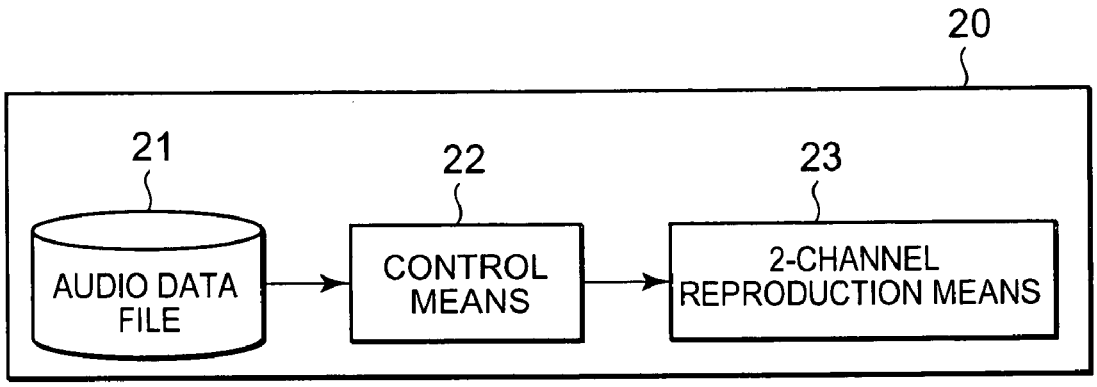
FIG. 5 is an example of a gain coefficient set for use in the acoustic image creation system according to Embodiment 1 of the present invention.
FIG. 6 is a flowchart illustrating the acoustic image creation system according to Embodiment 2 of the present invention.

Also, when sound quality is likely to be degraded due to expansion of the acoustic image, components that do not cause signal distortion become large by setting a gain coefficient set, e.g., as shown in FIG. 5, as sound quality-oriented gain coefficients, thereby allowing the sound quality to be improved.

It should be noted that while a configurational example has been described by referring to an example of 5.1-channel audio signals as multi-channel audio signals, it is apparent that even though the C and LFE signals are omitted from among what has been described therein, effects can be achieved without impairing the features of the present invention. Therefore, the multi-channel audio signal is not limited to a particular number of channels.

Embodiment 2

In Embodiment 1, the circuit configuration as shown in FIG. 1 has demonstrated a method of creating satisfactory surround acoustic images—from 5.1-channel audio signals. Such processing, however, can be implemented without employing a dedicated hardware device. A method will be described in which the processing equivalent to that in Embodiment 1 is implemented in a computer system that is equipped with a computer program-executable CPU (central processing unit), or in an LSI that sequentially executes instruction code sets stored in a ROM (read only memory), being provided in an acoustic image creation system according to Embodiment 2 of the present invention.

FIG. 6 is a block diagram illustrating a configuration of the acoustic image creation system in accordance with Embodiment 2 of the present invention. In this configurational example, processing will be described in which in an acoustic image creation system 20, a 2-channel reproduction means 23 converts by a control means 22, multi-channel audio data stored in an audio data file 21, into reproducible audio data.

Referring to FIG. 6, the audio data file 21 is a data file that stores the multi-channel audio signals in a digital data format, where the audio data file 21, for instance, is considered as the multi-channel audio data, to have stored 5.1-channel audio data. Note that the data file is referred to as not only a file stored on a magnetic disk, a DVD medium, or a CD medium, but also e.g., data to be stored on a memory chip, which are deemed to be technologically equivalent to the data file. In some cases data may be stored in a remote computer system connected with a communications network.

Note again that an audio data file format may include a digital audio signal format in which MP3 (mpeg audio layer-3) format data, AAC (advanced audio coding) format data, WAVE format data, or data in other various formats are saved.

Also, the control means 22 is a unit that is configured using a CPU and a memory medium for storing programs that create surround sound images. The 2-channel reproduction means 23 includes circuits, elements, and devices, for reproducing 2-channel audio data.

Figure 7:
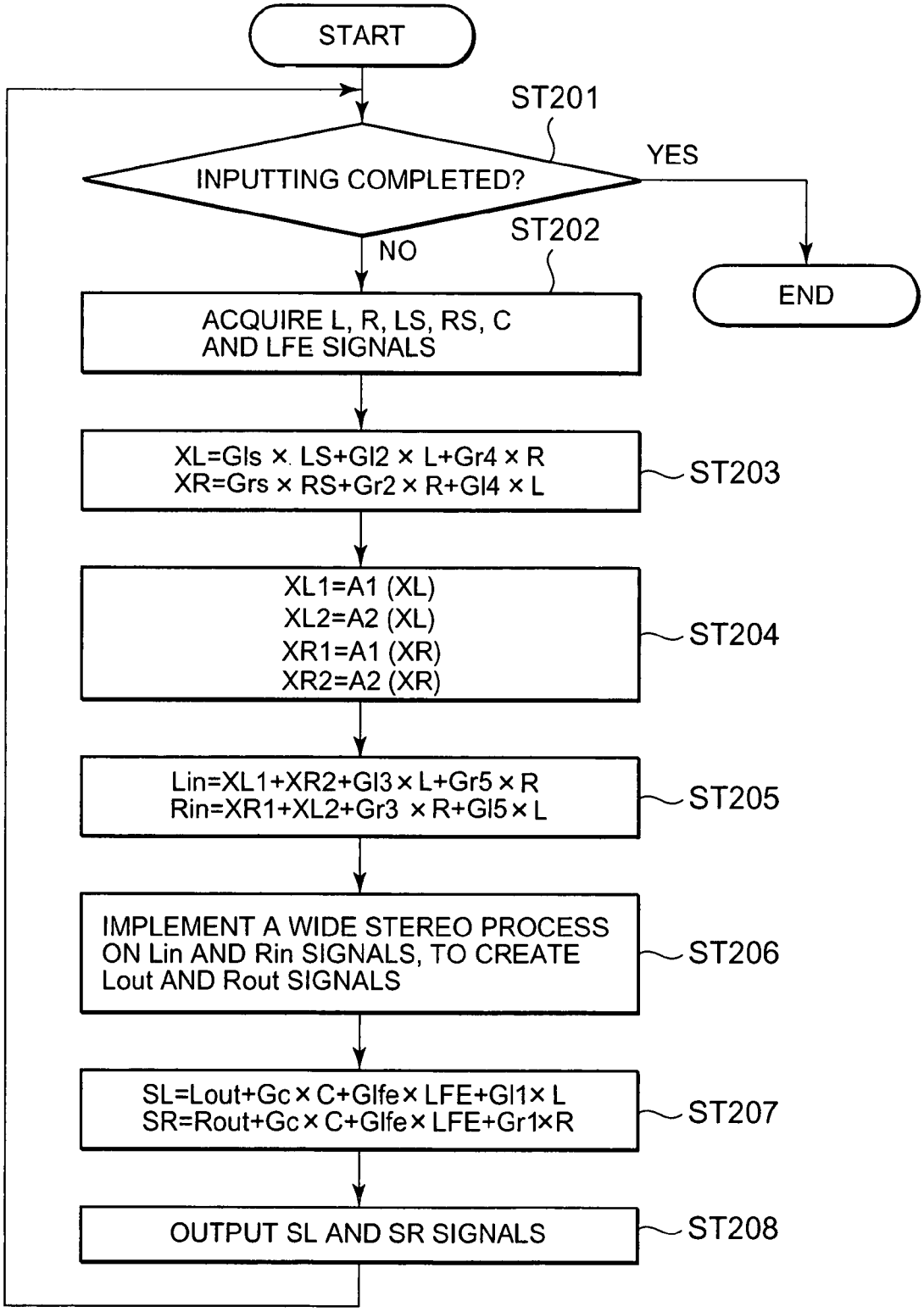
FIG. 7 is a flowchart illustrating the acoustic image creation system according to Embodiment 2 of the present invention.

Subsequently, the operation of the acoustic image creation system 20 will be described. FIG. 7 is a flowchart illustrating processing implemented by the acoustic image creation system 20. First, the control means 22 derives audio data from the audio data files 21. When further acquisition of the input data becomes impossible for reasons that for instance, a readout position of the audio data file 21 reaches EOF, data communication path between the audio data file 21 and the control means 22 is disconnected, or the like, input processing is determined to have been completed (ST201: Yes). When on the other hand, the audio data can be further acquired (ST201: No), Step ST202 ensues.

In Step ST202, the control means 22 acquires from the audio data file 21 an L signal, an R signal, an LS signal, an RS signal, a C signal, and an LFE signal. In Step ST 203, by multiplying the LS, L, and R signals by gain coefficients G1*s*, G12, and Gr4, respectively, and summing together each of the multiplication results, the summation result is assigned to be an XL signal. In addition, by multiplying the RS, R, and L signals by gain coefficients Grs, Gr2, and G14, respectively, and summing together each of the multiplication results, the summation result is assigned to be an XR signal.

Furthermore, the processing in Step ST202 is equivalent to that by the adders 114 and 123 in the acoustic image creation system 1 according to Embodiment 1. Therefore, technical effects are the same as those described in Embodiment 1.

Subsequently, the XL and the XR signals are processed by a rear localization filter (Step ST204), where, using the two spatial transfer functions A1 and A2, each of the signals is processed by the corresponding rear localization filter. A signal obtained by processing the XL signal by the rear localization filter having the spatial transfer function A1, is represented as an XL1 signal; a signal obtained by processing the XL signal by the rear localization filter having the transfer function A2, as an XL2 signal; a signal obtained by processing an XR signal by the rear localization filter having to the transfer function A1, as an XR1 signal; and a signal obtained by processing the XR signal by the rear localization filter having the transfer function A2, as the XL2 signal.

It should be noted that the spatial transfer function A1 simulates a state in which the XL signal—the left-rear signal—arrives at the listener's left ear, or the XR signal—the right-rear signal—arrives at the listener's right ear, while the spatial transfer function A2 simulates a state in which the XL signal—the left-rear signal—arrives at the listener's left ear, or the XR signal—the right-rear signal—arrives at the listener's left ear. In the acoustic creation system 1 according to Embodiment 1, these simulations implement the same processing as the rear localization filtering process to be implemented by using rear localization filters 130, 131, 135 and 136. That is, a rear localization filter 130 corresponds to a transfer function A1 (XL) a rear localization filter 131, to a transfer function A2(XL) a rear localization filter 135, to a transfer function A1(XR) and a rear localization filter 136, to a transfer function A2(X).

Since there is no relationship dependent on each other among four rear localization filtering processes to be implemented in Step ST 204, the execution order of these four processings does not matter, thereby allowing for their parallel execution.

Next, in Step ST 205, the sum of the XL1 and XR2 signals, the L signal multiplied by the gain coefficient G13, and the R signal multiplied by the gain coefficient Gr5 is regarded as an Lin signal. Furthermore, the XR1 and XL2 signals, the R signal multiplied by the gain coefficient Gr3, and the L signal multiplied by the gain coefficient G15 are summed together, and the summation result is regarded as an Rin signal. This processing corresponds to that by the adders 115 and 124 in Embodiment 1. Accordingly, technical effects are the same as those described in Embodiment 1.

Subsequently, the Lin signal and the Rin signal are processed by wide stereo process, so that, as an output signal processed by the wide stereo process, an Lout signal—the left signal—and an Rout signal—the right signal—are created (Step ST 206). The wide stereo processing will not be referred to in detail because it has already been described in Embodiment 1.

In Step ST207, the C signal obtained by multiplying the Lout signal by the gain coefficient Gc, the LFE signal, by multiplying Lout by the gain coefficient G1*fe*, and the L signal, by multiplying the Lout signal by the gain coefficient G11, are summed together to obtain an SL signal, as well as the C signal obtained by multiplying the Rout signal by the gain coefficient Gc, the LFE signal, by multiplying the Lout signal by the gain coefficient G1*fe*, and the R signal, by multiplying the Lout signal by the gain coefficient Gr1, are summed together to obtain an RL signal. Finally, with the SL and SR signals outputted into the 2-channel reproduction means 23 (Step 23), process flow returns to Step ST 201.

As seen from what has been described above, according to Embodiment 2 of the present invention, multi-channel audio data can be converted into 2-channel audio data, by means of a general-purpose arithmetic device as well, while the stereoscopic acoustic field characteristics of multi-channel audio data are well maintained.

It should be noted that the audio data file 21 is merely shown as an example of an audio signal source. In other words, it should be easily understood that based upon significance of technical idea, there is no reason at all why an audio signal source needs to be limited to configurations such as this. In configuring this acoustic creation system, accordingly, multi-channel audio signals do not need to be stored in a certain state. In place of the audio data file 21, for instance, audio signals collected by a microphone, etc., can easily be used as audio signals inputted into the control means 22. In addition, the audio signals, as source signals, may be supplied, for instance, in a form of analog or digital radio signals that is provided by a broadcast station.

INDUSTRIAL APPLICABILITY

The present invention is applicable generally to audio sound systems.

What is claimed is:

1. An acoustic image creation system for producing a left-right pair of surround sound image signals, from audio input signals including a left signal, a right signal, a left-rear signal, and a right-rear signal, the acoustic image creation system comprising:

a left-rear localization processor configured to output a left-rear localization signal by summing together the left signal and the left-rear signal into a left summation result and perform a first left rear-localization-filtering-process on the left summation result to create a first left rear-localization-filtering-process result as the left-rear localization signal;

a right-rear localization processing configured to output a right-rear localization signal by summing together the right signal and the right-rear signal into a right summation result and perform a first right rear-localization-filtering-process on the right summation result to create a first right rear-localization-filtering-process result as the right-rear localization signal; and an acoustic image creator configured to create the surround sound image signals, from the left signal, the right signal, the left-rear localization signal, and the right-rear localization signal.

2. The acoustic image creation system as recited in claim 1, wherein;

the left-rear localization processor is configured to perform said summing together the left signal and the left-rear signal by weighting and summing together the audio input signals' left signal and left-rear signal, and the right-rear localization processor is configured to perform said summing together the right signal and the right-rear signal by weighting and summing together the audio input signals' right signal and right-rear signal.

3. The acoustic image creation system as recited in claim 1, wherein:

the left-rear localization processor is further configured to left localization sum together the first left rear-localization-filtering-process result and the audio input signals' left signal into the left-rear localization signal; and the right-rear localization is further configured to right localization sum together the first right rear-localization-filtering-process result and the audio input signals' right signal into the right-rear localization signal.

4. The acoustic image creation system as recited in claim 3, wherein:

the left-rear localization processor is further configured to weight the audio input signals' left signal by a predetermined left gain coefficient before said left localization summing; and the right-rear localization processor is further configured to weight the audio input signals' right signal by a predetermined right gain coefficient before said right localization summing.

5. The acoustic image creation system as recited in claim 4, wherein:

the left-rear localization processor is further configured to left-mixed sum right-localized signal component, obtained by performing a second right rear-localization-filtering-process on the audio signals' right signal and right-rear signal, into the left-rear localization signal and the right-rear localization is further configured to right-mixed sum left-localized signal component, obtained by performing a second left localization-filtering-process on the audio signals' left signal and left-rear signal, into the right-rear localization signal.

6. The acoustic image creation system as recited in claim 1, wherein the acoustic image creator is configured to create:

a wide-stereo-converted left signal and a wide-stereo-converted right signal by processing, with a wide stereo process, the left-rear localization signal that the left-rear localization processor outputs and the right-rear localization signal that the right-rear localization processor outputs;

a left signal for a surround acoustic image signal, from the wide-stereo-converted left signal and the audio signals' left signal; and a right signal for the surround acoustic signal, from the wide-stereo-converted right signal and the audio signals' right signal.

7. A computer-readable storage medium, having embodied thereon an acoustic image creation program for creating a left-right pair of surround sound image signals, from audio input signals containing a left signal, a right signal, a left-rear signal, and a right-rear signal, wherein the program, when executed, causes a computer to perform the steps of:

a left-rear-localization-process step of creating a left-rear localization signal, where said creating a left-rear localization signal includes left-signal summing together the left signal and the left-rear signal into a left summation result and performing a first left rear-localization-filtering-process on the left summation result to create a first left rear-localization-filtering-process result;

a right-rear-localization-process step of creating a right-rear localization signal, where said creating a right-rear localization signal includes right-signal summing together the right signal and the right-rear signal into a right summation result and performing a first right rear-localization-filtering-process on the right summation result to create a first right rear-localization-filtering-process result; and an acoustic image creation step of creating the surround sound image signals, from the left signal, the right signal, the left-rear localization signal, and the right-rear localization signal.

8. The medium of claim 7, wherein:

the left-rear localization process step further comprises left-localization summing together the first left rear-localization-filtering-process result and the audio input signals' left signal into the left-rear localization signal; and the right-rear localization process step further comprises right-localization summing together the first right rear-localization-filtering-process result and the audio input signals' right signal into the right-rear localization signal.

9. The medium of claim 8, wherein:

the left-rear localization process step further comprises weighting the audio signals' left signal by a predetermined left gain coefficient before said left-localization summing, and said left-localization summing further includes summing a signal component obtained by performing a second right rear-localization-filtering-process on the audio signals' right signal and right-rear signal into the left-rear localization signal; and the right-rear localization process step further comprises weighting the audio signals' right signal by a predetermined right gain coefficient before said right-localization summing, and said right-localization summing further includes summing signal component obtained by performing a second left rear-localization-filtering-processing, the audio signals' left signal and left-rear signal into the left-rear localization signal.

10. The medium of claim 7, wherein the acoustic creation step creates:

a wide-stereo-converted left signal and a wide-stereo-converted right signal, by processing with a wide-stereo process, the left-rear localization signal created in the left-rear localization process step, and the right-rear localization signal created in the right-rear localization process step;

a left signal for surround image acoustic signals from a wide-stereo-converted left signal, and the audio signals' left signal; and a right signal for the surround sound image signal from a combination of the wide-stereo-converted right signal, and the audio signals' right signal.

11. An acoustic image creation method for creating a left-right pair of surround sound image signals, from audio input signals containing a left signal, a right signal, a left-rear signal, and a right-rear signal, the method comprising the steps of:

a left-rear-localization-process step of creating a left-rear localization signal, where said creating a left-rear localization signal includes left-signal summing together the left signal and the left-rear signal into a left summation result and performing a first left rear-localization-filtering-process on the left summation result to create a first left rear-localization-filtering-process result;

a right-rear-localization-process step of creating a right-rear localization signal, where said creating a right-rear localization signal includes right-signal summing together the right signal and the right-rear signal into a right summation result and performing a first right rear-localization-filtering-process on the right summation result to create a first right rear-localization-filtering-process result; and an acoustic image creation step of creating the surround sound image signals, from the left signal, the right signal, the left-rear localization signal, and the right-rear localization signal.

12. The method of claim 11, wherein:

the left-rear localization process step further comprises left-localization summing together the first left rear-localization-filtering-process result and the audio input signals' left signal into the left-rear localization signal; and the right-rear localization process step further comprises right-localization summing together the first right rear-localization-filtering-process result and the audio input signals' right signal into the right-rear localization.

13. The method of claim 12, wherein:

the left-rear localization process step further comprises weighting the audio signals' left signal by a predetermined left gain coefficient before said left-localization summing, and said left-localization summing further includes summing a signal component obtained by performing a second right rear-localization-filtering-process on the audio signals' right signal and right-rear signal into the left-rear localization signal; and the right-rear localization process step further comprises weighting the audio signals' right signal by a predetermined right gain coefficient before said right-localization summing, and said right-localization summing further includes summing a signal component obtained by performing a second left rear-localization-filtering-processing, the audio signals' left signal and left-rear signal into the left-rear localization signal.

14. The method of claim 11, wherein the acoustic creation step creates:

a wide-stereo-converted left signal and a wide-stereo-converted right signal, by processing with a wide-stereo process, the left-rear localization signal created in the left-rear localization process step, and the right-rear localization signal created in the right-rear localization process step;

a left signal for surround image acoustic signals from a wide-stereo-converted left signal, and the audio signals' left signal; and a right signal for the surround sound image signal from a combination of the wide-stereo-converted right signal, and the audio signals' right signal.

* * * * *